US008469742B2

(12) United States Patent
Shiga

(10) Patent No.: US 8,469,742 B2
(45) Date of Patent: Jun. 25, 2013

(54) WIRE SEAL HAVING A BODY WITH A PROJECTION INSERTABLE INTO A CONTACT INSERTION PASSAGEWAY

(75) Inventor: Katsumi Shiga, Chiba (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 12 days.

(21) Appl. No.: 13/328,303

(22) Filed: Dec. 16, 2011

(65) Prior Publication Data

US 2012/0156927 A1 Jun. 21, 2012

(30) Foreign Application Priority Data

Dec. 17, 2010 (JP) ..... 2010-281658

(51) Int. Cl.
*H01R 13/40* (2006.01)

(52) U.S. Cl.
USPC ..... 439/587

(58) Field of Classification Search
USPC ..... 439/587, 271–275, 548
See application file for complete search history.

(56) References Cited

U.S. PATENT DOCUMENTS 6,390,848 B1 * 5/2002 Murakami et al. ..... 439/587
6,398,585 B1 * 6/2002 Fukuda ..... 439/587
6,409,541 B1 * 6/2002 Hattori et al. ..... 439/587
6,508,666 B1 * 1/2003 Francis ..... 439/548
6,739,908 B2 * 5/2004 Hamai et al. ..... 439/587
7,044,762 B1 * 5/2006 Hong et al. ..... 439/275
2011/0300731 A1 * 12/2011 Nakamura ..... 439/271

FOREIGN PATENT DOCUMENTS

JP 2006-324161 A 11/2006
JP 2009-204954 A 9/2009

* cited by examiner

*Primary Examiner* — Chandrika Prasad
(74) *Attorney, Agent, or Firm* — Barley Snyder

(57) ABSTRACT

A waterproof connector is provided with a connector housing and a wire seal. The connector housing includes a plurality of first contact insertion passageways. The wire seal includes a wire seal body and at least one projection. The wire seal body includes a plurality of second contact insertion passageways disposed at positions corresponding to the plurality of first contact insertion passageways and receive a plurality of contacts pressed tightly against edges of inner perimeters of the plurality of second contact insertion passageways to seal the plurality of second contact insertion passageways when the contacts are inserted through the plurality of second contact insertion passageways. The at least one projection extends from the wire seal body and is disposed along positions corresponding to any of the plurality of first contact insertion passageways. The plurality of second contact insertion passageways are insertable through the first contact insertion passageway.

8 Claims, 5 Drawing Sheets

WIRE SEAL HAVING A BODY WITH A PROJECTION INSERTABLE INTO A CONTACT INSERTION PASSAGEWAY

CROSS-REFERENCE TO RELATED APPLICATIONS

This application claims the benefit of the filing date under 35 U.S.C. §119(a)-(d) of Tyco Electronics Japan G.K. Patent Application No. 2010-281658, filed Dec. 17, 2010.

FIELD OF THE INVENTION

The invention relates to a waterproof connector and in particular to a waterproof connector using a wire seal.

BACKGROUND

Some known waterproof connectors include a so called wire seal or all-in-one rubber seal inside a connector housing to prevent water and the like from entering the housing from outside. The wire seal has contact insertion passageways thereon along positioned corresponding to respective passageways in the connector housing, and is adopted to ensure a waterproof function by allowing wires connected with contacts to be pressed tightly against the edges of inner perimeters of the contact insertion passageways when the contacts are inserted into the passageways through the contact insertion passageways. The circuit board that connects with the waterproof connector has various specifications. The number of passageways formed on the connector is decided correspondingly to the largest number of contacts required among the specifications of the circuit board. As a result, the contacts are not necessarily inserted into all the passageways for some circuit boards to connect with. In that case, the contact insertion passageways corresponding to hollow spaces, the passageways that the contacts are not inserted into, are closed with plugs, so called dummy plugs, to ensure the waterproof function. It is inefficient, however, for an operator to insert the dummy plugs into the hollow spaces of the connector housing with many hollow spaces.

In view of the aforementioned circumstances, Japanese Patent No. 3174261 and Japanese Patent Application Laid-Open No. 2006-324161 propose covers with built-in dummy plugs which have dummy plugs in locations corresponding to the hollow spaces. The covers have dummy plugs projecting therefrom that fit in all the respective contact insertion passageways of the wire seal. The covers are adopted to form the contact insertion passageways by allowing jigs to punch the dummy plugs corresponding to the passageways in which the contacts are to be inserted since the dummy plugs have thin-walled parts.

In Japanese Patent No. 3174261 and Japanese Patent Application Laid-Open No. 2006-324161, a step of using jigs to break through the dummy plugs corresponding to the passageways in which the contacts are to be inserted is necessary after production of the covers with built-in dummy plugs. It is efficient of an operator in performing this step, in fact, it is as inefficient as the step of inserting the dummy plugs into the hollow spaces one by one. Specifically, in Japanese Patent No. 3174261, perforating pins are attached to respective threaded passageways of an upper base (jig), and then the upper base attached with the perforating pins is pressed onto a lower base (jig) so that cutting edges break through unnecessary dummy plugs. When a connector housing has fewer hollow spaces, an operator has to attach more perforating pins to the connector housing, which is much more troublesome than to insert the dummy plugs into the hollow spaces one by one.

Since the covers with built-in dummy plugs of Japanese Patent No. 3174261 and Japanese Patent Application Laid-Open No. 2006-324161 require significant force to simultaneously break through the dummy plugs, only experienced operators can perform the step of breaking through the dummy plugs without having the jigs slip off.

In addition, the covers with built-in dummy plugs of Japanese Patent No. 3174261 and Japanese Patent Application Laid-Open No. 2006-324161 waste material by disposal of the broken-through dummy plugs.

SUMMARY

An object of the present invention, inter alia, is to provide a wire seal that does not need a step of breaking through the dummy plugs and reduces the workload of placing the dummy plugs into the hollow spaces. Another object of the present invention is to provide a waterproof connector using the wire seal.

The waterproof connector housing includes a plurality of first contact insertion passageways. The wire seal includes a wire seal body and at least one projection. The wire seal body has a plurality of second contact insertion passageways disposed at positions corresponding to the plurality of first contact insertion passageways. The plurality of second contact insertion passageways receive a plurality of contacts that are pressed tightly against edges of inner perimeters of the plurality of second contact insertion passageways to seal the plurality of second contact insertion passageways when the contacts are inserted through the plurality of second contact insertion passageways. The at least one projection extends from the wire seal body and is disposed along positions that correspond to any of the plurality of the plurality of first contact insertion passageways. The plurality of second contact insertion passageways are insertable through the first contact insertion passageway.

BRIEF DESCRIPTION OF THE DRAWINGS

The above and other objects, features and other advantages of the invention will be more clearly understood from the following detailed description taken in conjunction with the accompanying drawings, in which.

DETAILED DESCRIPTION OF THE EMBODIMENT(S)

Figure 1:
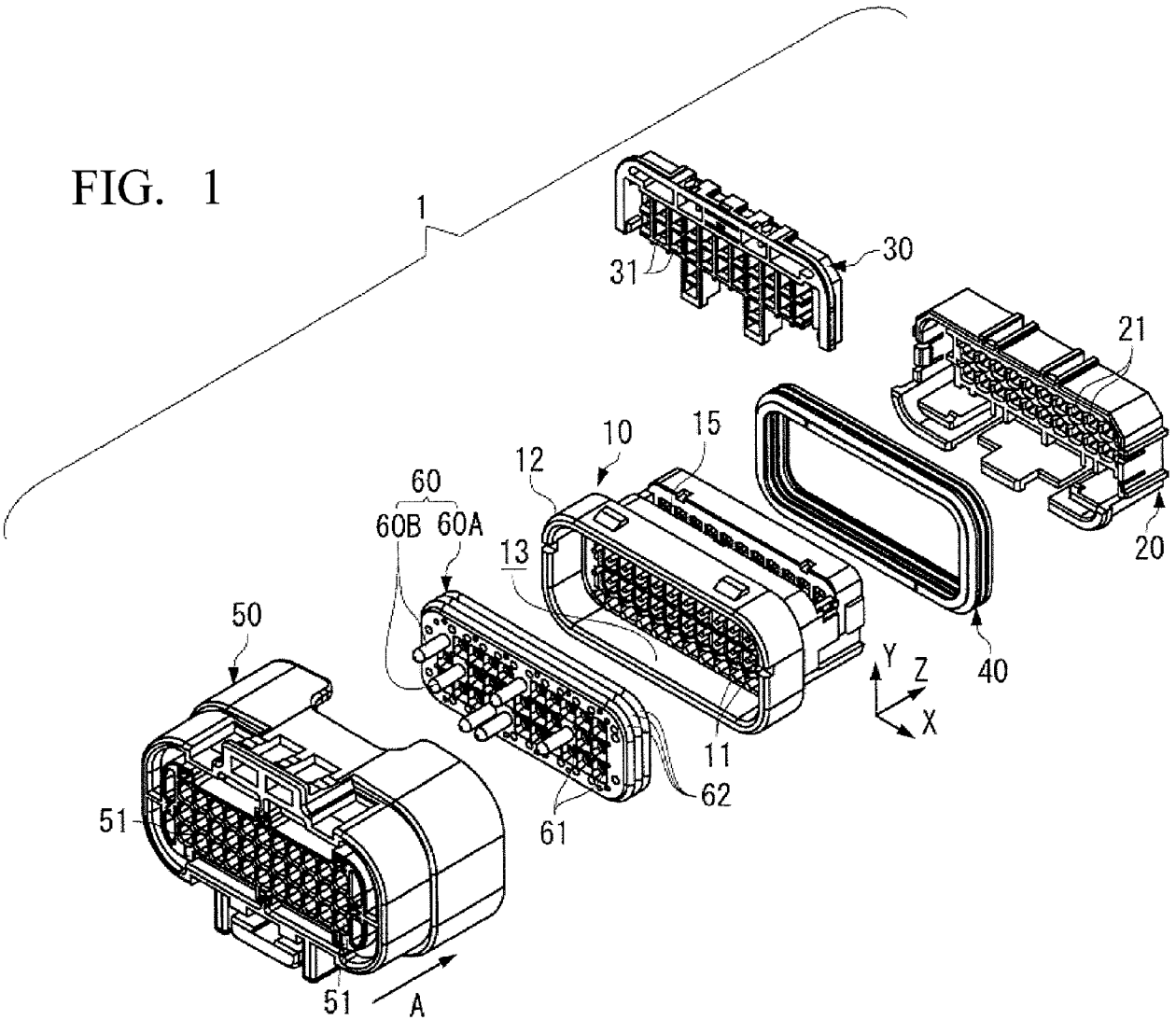
FIG. 1 is an exploded perspective view of a waterproof connector according to the invention.

The invention will be described below based on the embodiments with reference to the drawings.

A waterproof connector 1 shown in FIGS. 1 to 4 has an inner housing 10, a cover 20, a retainer 30, a seal member 40, an outer housing 50, and a wire seal 60.

The inner housing 10 is formed in a substantially rectangular parallelepiped shape extending in a cross direction (in the direction X in FIG. 1), a vertical direction (in the direction Y in FIG. 1), and a front-back direction (in the direction Z in FIG. 1).

The inner housing 10 includes a plurality of contact receiving passageways 11 for receiving contacts for electric use or for signal use, not shown (hereinafter, both kinds of contacts are collectively referred to as "contact"). The contact is inserted into each of the contact receiving passageways 11, in the direction shown by an arrow A in FIG. 1.

Each of the contact receiving passageways 11 is formed through the inner housing 10 in the front-back direction and includes a housing lance 16 (FIG. 2B) for generally latching the contact.

The inner housing 10 includes a surrounding wall 12, the inner side of which constitutes a seal receiving concave section 13 for receiving the wire seal 60. The surrounding wall 12 extends forward from the front end perimeter of the inner housing 10 that faces the outer housing 50.

The inner housing 10 also includes a retainer receiving concave section 15 on which the retainer 30 is to be mounted. The retainer receiving concave section 15 is provided in the rearward of the seal receiving concave section 13.

Herein, the side of the waterproof connector 1 from which the contacts are inserted is considered the front side.

The seal member 40, which is formed by injection-molding insulation rubber in a ring shape as shown in FIG. 1, is adapted to closely adhere to the outer surface of the inner housing 10. For the case in which the waterproof connector 1 is engaged with a mating connector (not shown), the seal member 40 has a function of sealing between a counterpart housing (not shown) of the mating connector and the inner housing 10 to prevent water from penetrating the inner housing 10 through the engaging part.

The cover 20, which is formed by injection-molding insulation resin, is configured to mount on a rear side of the inner housing 10. As shown in FIG. 1, the cover 20 extends in the cross direction to cover the rear side of the inner housing 10, and counterpart contact insertion passageways 21 through which counterpart contacts are inserted are formed through the cover 20 in the front-back direction.

The retainer 30 is formed by injection-molding insulation resin in a substantially plate shape extending in the cross direction as shown in FIG. 1. The retainer 30 is configured to mount on the inside of the retainer receiving concave section 15 formed in the inner housing 10. The retainer 30 has a plurality of contact insertion passageways 31 formed correspondingly to the contact receiving passageways 11 provided in the inner housing 10. The retainer 30 is temporarily held in the inner housing 10 at a temporary latching position where the contacts are allowed to be inserted into the contact receiving passageways 11 through the contact insertion passageways 31. The retainer 30 is further pressed into and fixed to the inner housing 10 at a proper latching position. When the retainer 30 is fixed to the inner housing 10 at the proper latching position, the contacts are secondarily latched by the retainer 30.

The outer housing 50 is mounted on and covers the seal receiving concave section 13, which receives the wire seal 60, and prevents the wire seal 60 from slipping off. In other words, the wire seal 60 is housed in the outer housing 50.

The outer housing 50 includes a plurality of contact insertion passageways 51 (first contact insertion passageways) formed at positions corresponding to the contact receiving passageways 11. The contact insertion passageways 51 are formed through the outer housing 50 in the front-back direction so that wires W (FIG. 4) connected with the contacts are led to the rear side of the outer housing 50 through the contact insertion passageways 51.

Herein, a contact insertion face is positioned along a side of the outer housing 50 through which the contacts are inserted. As shown in FIG. 2A, identification codes such as numerals are given at predetermined places on the contact insertion face. The identification codes facilitate identification of the respective contact insertion passageways 51 for the operator. Although not limited, in the case of a connector with a small number of poles or a connector with a small space, the identification codes such as numerals may not be provided.

The wire seal 60 is an integrated waterproof member having a wire seal body 60A formed in a substantially plate shape. The wire seal 60 is received in the seal receiving concave section 13 of the inner housing 10. The wire seal 60 is usually made of elastomer (elastic polymer), but it may be made of any material which has a waterproof function.

Figure 3A:
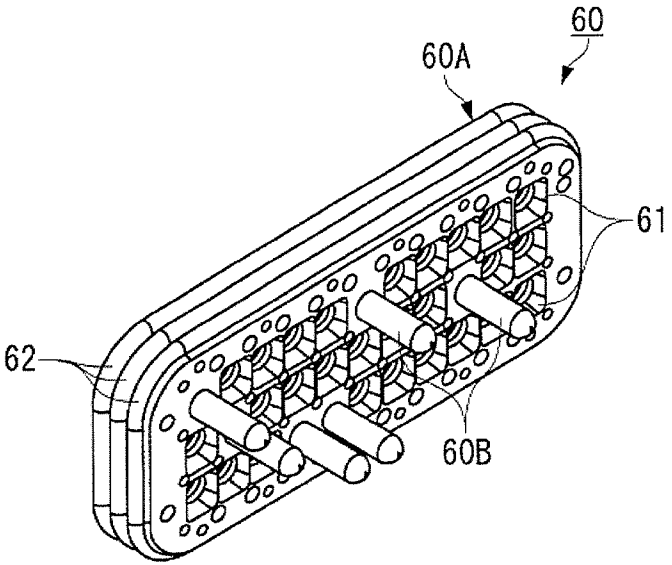
FIG. 3A is a perspective view of a wire seal of the waterproof connector according to the invention.

The wire seal body 60A has the outer surface shape and dimensions to closely adhere to the inner surface of the surrounding wall 12. As shown in FIGS. 1 and 3A, a plurality of ridges 62 are provided on the outer surface of the wire seal body 60A for improving the adhesion with the inner surface of the surrounding wall 12 of the inner housing 10.

The wire seal body 60A has a plurality of contact insertion passageways 61 (second contact insertion passageways) disposed at positions corresponding to the contact receiving passageways 11. The contact insertion passageways 61 are formed through the wire seal body 60A in the thickness direction so that wires W connected with the contacts which are received in the contact receiving passageways 11 are led to the rear side of the wire seal 60 through the contact insertion passageways 61.

Figure 4:
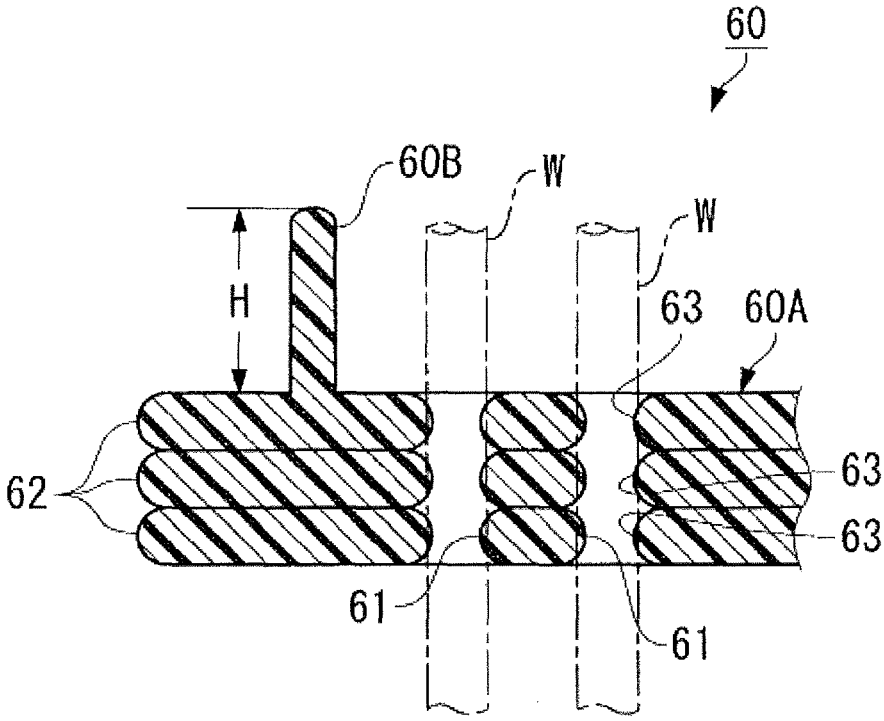
FIG. 4 is a cross-sectional view schematically showing wires inserted into the wire seal according to the invention.

As shown in FIG. 4, a plurality of ridges 63 are provided on the inner surface of each of the contact insertion passageways 61 and closely adhere to the outer surface of each of the wires W. They can prevent water from penetrating through each of the contact insertion passageways 61 into the inside of the inner housing 10. The diameter of the wire W connected with the contact is about 1.0 mm, which is larger than the diameter of the wire W connected with the signal contact. On the other hand, the diameter of the wire W connected with the signal contact is about 0.5 mm. The diameter of the wire refers to the outer diameter of its coating. The opening diameter of the contact insertion passageways 61 and the projection of the ridges 63 are decided as required by taking account of the diameter of the wire. Here, the diameters of the wires W are merely examples. As an example, in the connector according to the embodiment, wires for the electric use and wires for the signal use are connected with the terminals of the same size as necessary. For example, the coating diameter of the wire may be 2.4 mm at the maximum for electric use and 1.6 mm at the minimum for signal use.

In the waterproof connector 1 of the above configuration, one or more of the contact receiving passageways 11 may be left as a vacant passageways (hollow spaces), in which no contact is received. In the conventional waterproof connector, waterproofness is achieved by inserting dummy plugs into all of the contact insertion passageways 61 of the wire seal 60 corresponding to the hollow spaces. Otherwise, the covers with built-in dummy plugs are used as in Japanese Patent No. 3174261 and Japanese Patent Application Laid-Open No. 2006-324161.

On the other hand, the wire seal 60 according to the invention has projections 60B instead of the contact insertion passageways 61 formed at the places corresponding to the hollow spaces.

As shown in FIG. 1, the projections 60B are formed on the front of the wire seal body 60A, i.e., on the side facing the outer housing 50. Herein, the side of the wire seal body 60A on which the projections 60B are formed is referred to as projection forming face. As shown in FIG. 4, the projection 60B has a constant thickness and extends substantially perpendicular to the projection forming face. In the cases of the projection which is thick enough to be tapered and the like, though not limited, the projection may be tapered to facilitate the insertion.

The projection 60B may be integrally molded with the wire seal body 60A when the wire seal 60 is injection-molded. The change in the specification of a metal mold used for the above injection-molding is slight compared to the change made to form the dummy plugs on the housing side. Therefore, the cost needed for the metal mold is lower than that for the cover with built-in dummy plugs. The wire seal 60 may be produced by any molding method such as compression molding and transfer molding other than injection-molding (LIM) as in the embodiment.

In Japanese Patent No. 3174261 and Japanese Patent Application Laid-Open No. 2006-324161, the step of using jigs to break through the dummy plugs corresponding to the passageways in which the contacts are to be inserted is necessary after production of the covers with built-in dummy plugs as mentioned above. On the other hand, the invention uses the wire seal 60 with the projections 60B formed at positions where the dummy plugs are needed and the contact insertion passageways 61 formed at the places where the dummy plugs are not needed. Therefore, the invention does not need the step of using jigs to break through the dummy plugs, and thus, does not waste material to dispose the broken-through dummy plugs.

Figure 2B:
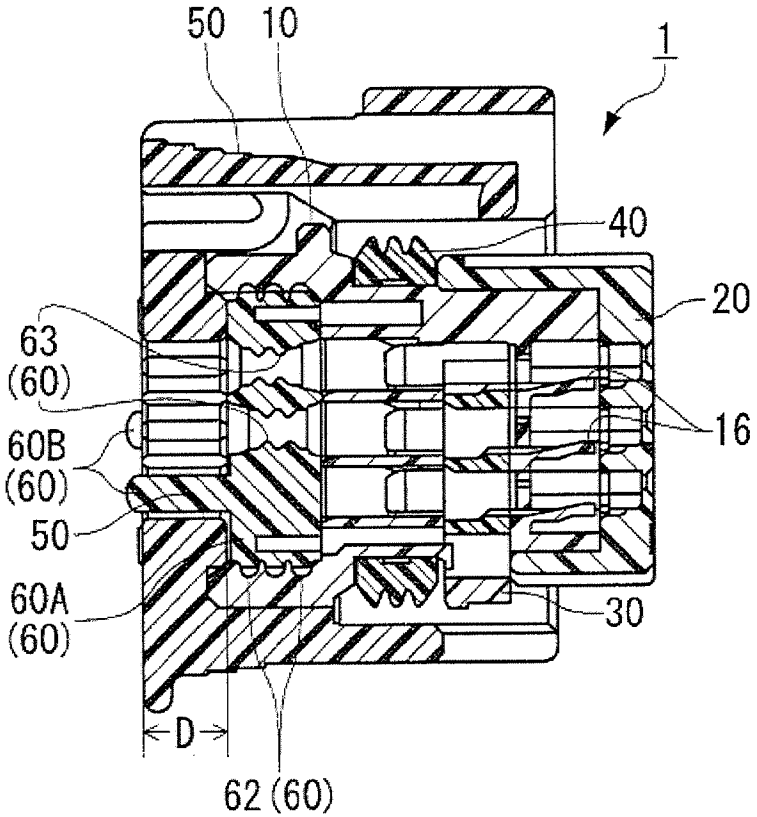
FIG. 2B is a cross-sectional view of the waterproof connector taken along line 2*b*-2*b* of FIG. 2A.
Figure 2A:
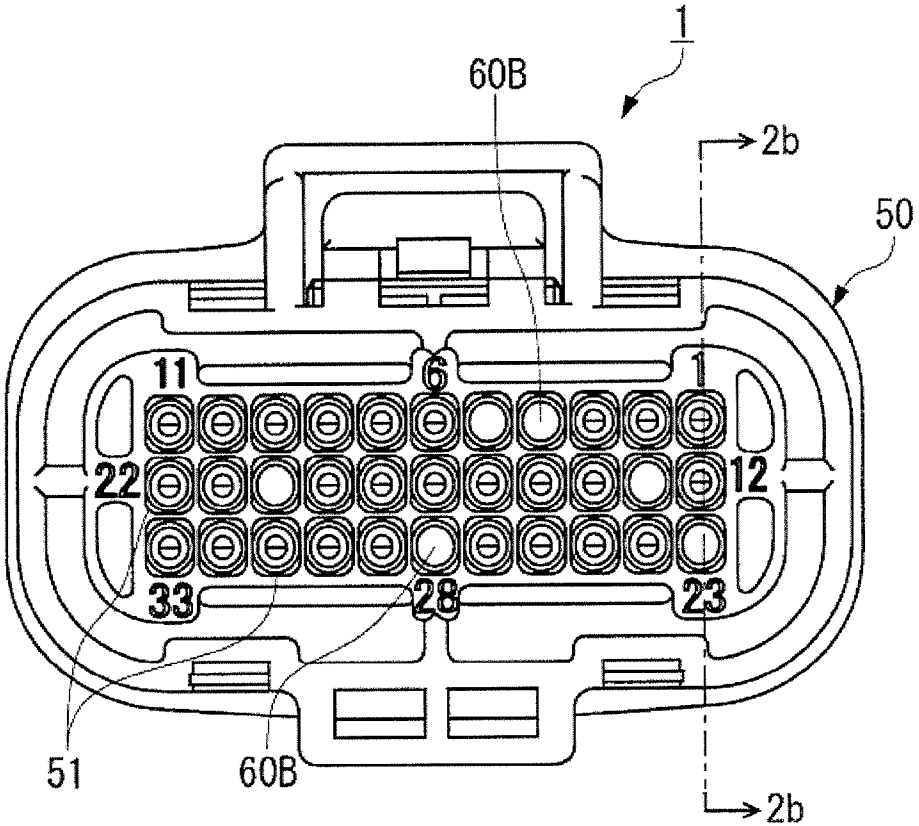
FIG. 2A is a front plan view of the waterproof connector according to the invention.
Figure 3B:
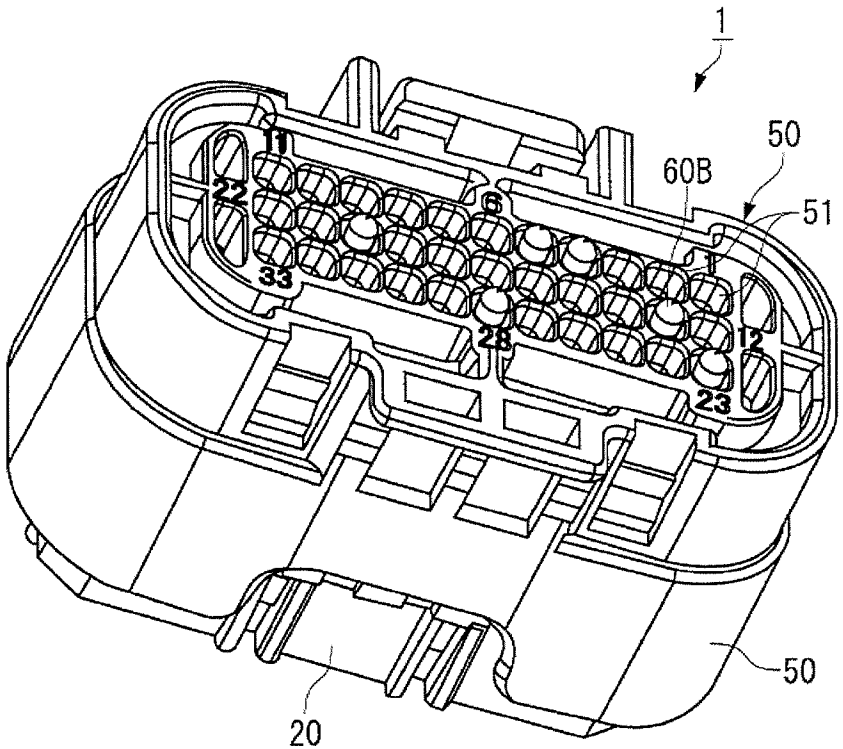
FIG. 3B is a perspective view of a waterproof connector according to the invention when assembled with the wire seal shown in FIG. 3A.

As shown in FIGS. 2B and 3B, after the waterproof connector 1 is assembled, the projections 60B are inserted through the contact insertion passageways 51 of the outer housing 50. Although the projection 60B has a cylindrical shape with a hemispherical head in the embodiment shown, the projection may be in any shape that can be placed in the contact insertion passageway 51 of the outer housing 50.

With respect to FIG. 4, the height H of the projection 60B is set according to the depth D of the contact insertion passageway 51 of the outer housing 50 (see FIG. 2B). Not only the design in which the height H of the projection 60B is the same as the depth D of the contact insertion passageway 51 (H=D) but also the design in which the height H of the projection 60B is larger than the depth D of the contact insertion passageway 51 (H>D) or the form in which the height H of the projection 60B is less than the depth D of the contact insertion passageway 51 (H<D) may be adopted. FIG. 2B shows when the projections 60B pierce the contact insertion passageways 51 and the hemispherical heads of the projections 60B are protruded from the contact insertion passageways 51, i.e., the case of H>D in which the projections 60B are exposed outside from the contact insertion face.

In the case of H>D, the projection 60B can be easily viewed from the side of the contact insertion face of the outer housing 50 as shown in FIG. 2A. Therefore, the places of the vacant passageways (hollow spaces) in which no contact is received are obvious so that the operator can easily distinguish the place to insert the contact and the place not to insert the contact. This significantly improves the conventional work efficiency in inserting the contacts into the contact insertion passageways 51 and prevents accidental insertion.

In the case where the height H of the projection 60B is set less than the depth D of the contact insertion passageway 51 (H<D), it is preferably $D/2 \leqq H$, and more preferably $2D/3 \leqq H$ to make the projections 60B easily viewed from the side of the contact insertion face of the outer housing 50. In the case of H<D, the effects of improving the work efficiency in inserting the contacts and preventing accidental insertion can be expected, while reducing the amount of material required for the wire seal 60.

After the outer housing receives the conventional wire seal that has the contact insertion passageways provided at the places corresponding to the respective passageways in the connector housing, it is difficult to view the color of the wire seal from outside of the waterproof connector.

On the other hand, after the outer housing 50 receives the wire seal 60 that has the projections 60B, the color of the projections 60B can be viewed from outside of the waterproof connector 1. For that purpose, the wire seal 60 is preferably set to a color different from that of the outer housing 50. For example, if the wire seal 60 is light colored and the outer housing 50 is dark colored, the operator can easily distinguish the projection 60B even in the case of H<D. Colors in white color system may be used as a light color and colors in black color system may be used as a dark color. The combination of colors is not limited to the light color and the dark color, and any combination that improves the visibility of the projections 60B may be used.

Although the shown embodiment includes six projections 60B, the number and the positions of the projections 60B are merely examples and the present invention is not limited to them. Although the case that the projections 60B are integrally molded with the wire seal body 60A is shown, the present invention is not limited to that. For example, only hardness of the projections can be increased by two-color molding (double molding) or the like. The descriptions of the inner housing 10 and the outer housing 50 are merely examples, and it is needless to say that the wire seal according to the present invention may be applied to the waterproof connector in any form on which the wire seal is mounted.

Figure 5B:
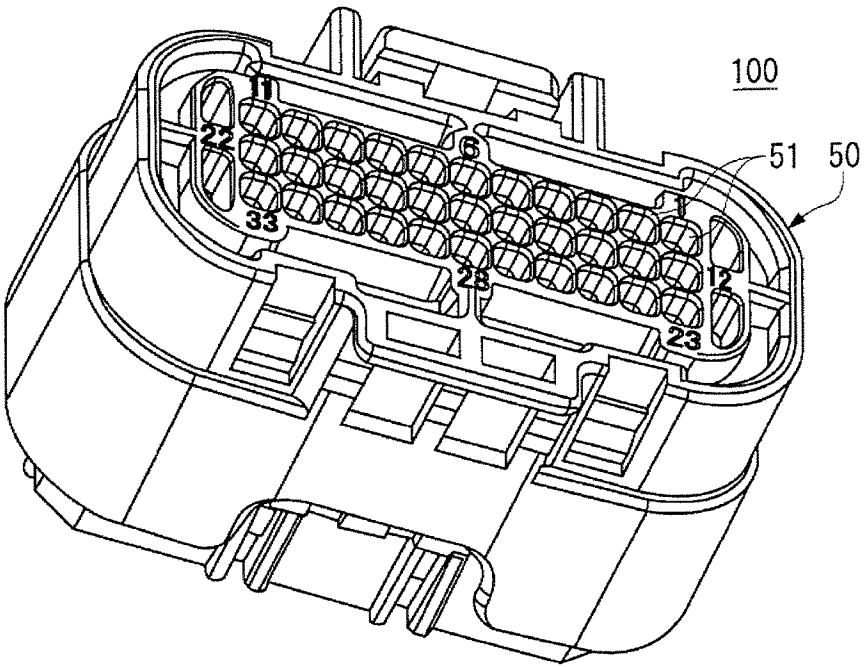
FIG. 5B is a perspective view of another waterproof connector according to the invention that is assembled with the wire seal shown in FIG. 5A.
Figure 5A:
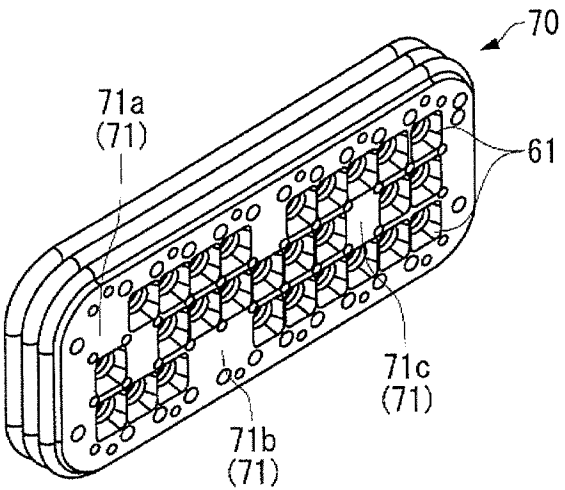
FIG. 5A is a perspective view of another wire seal according to the invention in which the places corresponding to passageways which are to be the hollow spaces with no contact inserted are closed.

Also, the wire seal 60 according to the invention may be concurrently used with the closed region 71 shown in FIG. 5A as required. Once the specifications of the waterproof connector 1 are decided, the contact receiving passageways 11 used as hollow spaces will be apparent. For example, the projection 60B may not be formed on a closed region 71*a* shown in FIG. 5A which is to be hollow space in most specifications and the place of which is relatively distinguishable, and the projection 60B may be formed at the places corresponding to closed regions 71*b* and 71*c*, the places of which are relatively indistinguishable.

The wire seal 60 according to the invention may be concurrently used with the conventional dummy plugs. For example, when the projections 60B are at the same places of the projections on the wire seal 60 shown in FIG. 3B and one more projection 60B is needed at another place, the conventional dummy plug may be inserted through that another place.

Generally, conventional covers with built-in dummy plugs are intended to reduce the workload of inserting the dummy plugs into the wire seal by providing the dummy plugs on the connector housing. The invention using an opposite approach to that of the conventional covers. That is, the invention closes the positions corresponding to vacant passageways, which are to be hollow spaces, in contrast to the conventional approach of providing the contact insertion passageways on the wire seal at places corresponding to all the passageways of the connector housing. With the wire seal according to the invention, the workload of placing the dummy plugs into the hollow spaces can be reduced.

Other than these structures, the configurations described above in the embodiments can be chosen or changed to other configurations as required without departing from the spirit of the present invention.

The invention is applicable not only to the waterproof connector but also to a non-watertight type connector having passageways in which no contact is received. For example, the insertion of the contacts into the passageways can be physically blocked by providing projections on the resin member that is to be received in the inner housing so that the projections can be viewed from the contact insertion face of the outer housing.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A wire seal received in a connector housing having a plurality of first contact insertion passageways, the wire seal comprising:

a wire seal body having a plurality of second contact insertion passageways disposed at positions corresponding to the plurality of first contact insertion passageways and receiving contacts that are pressed tightly against edges of inner perimeters of the plurality of second contact insertion passageways to seal the plurality of second contact insertion passageways when the contacts are inserted through the plurality of second contact insertion passageways; and at least one projection extending from the wire seal body and disposed at a position corresponding to at least one of the plurality of first contact insertion passageways and insertable into the at least one of the plurality of first contact insertion passageways wherein the at least projection is inserted into the at least one of the plurality of first contact insertion passageways which is left as hollow space without a contact inserted therein.

2. The wire seal according to claim 1, further comprising a plurality of ridges disposed on an inner surface of each of the plurality of second contact insertion passageways.

3. The wire seal according to claim 2, wherein the plurality of ridges are configured to closely adhere to an outer surface of each of the wires inserted through the plurality of second contact insertion passageways.

4. A waterproof connector, comprising:

a connector housing having a plurality of first contact insertion passageways; and a wire seal having:

a wire seal body having a plurality of second contact insertion passageways disposed at positions corresponding to the plurality of first contact insertion passageways and receiving a plurality of contacts that are pressed tightly against edges of inner perimeters of the plurality of second contact insertion passageways to seal the plurality of second contact insertion passageways when the plurality of contacts are inserted through the plurality of second contact insertion passageways; and at least one projection extending from the wire seal body and disposed at a position corresponding to at least one of the plurality of first contact insertion passageways and insertable into the at least one of the plurality of first contact insertion passageways wherein the at least projection is inserted into the at least one of the plurality of first contact insertion passageways which is left as hollow space without a contact inserted therein.

5. The waterproof connector according to claim 4, wherein the connector housing includes a contact insertion face through which the plurality of contacts are inserted and the at least one projection is high enough to be seen from the contact insertion face when the wire seal is inserted into the connector housing.

6. The waterproof connector according to claim 5, wherein the at least one projection extends through the at least one of the plurality of first contact insertion passageways and beyond the contact insertion face.

7. The wire seal according to claim 4, further comprising a plurality of ridges disposed on an inner surface of each of the plurality of second contact insertion passageways.

8. The wire seal according to claim 7, wherein the plurality of ridges are configured to closely adhere to an outer surface of each of the wires inserted through the plurality of second contact insertion passageways.

* * * * *